US012108868B2

(12) United States Patent
Dai

(10) Patent No.: US 12,108,868 B2
(45) Date of Patent: Oct. 8, 2024

(54) POWERED TOOL BRUSH AND POWERED TOOL HAVING SAME

(71) Applicant: NINGHAI ZHONG JIE BRUSH CO., LTD., Zhejiang (CN)

(72) Inventor: Ce Dai, Zhejiang (CN)

(73) Assignee: NINGHAI ZHONG JIE BRUSH CO., LTD., Ningbo (CN)

( * ) Notice: Subject to any disclaimer, the term of this patent is extended or adjusted under 35 U.S.C. 154(b) by 316 days.

(21) Appl. No.: 17/885,535

(22) Filed: Aug. 10, 2022

(65) Prior Publication Data

US 2024/0032683 A1 Feb. 1, 2024

(30) Foreign Application Priority Data

Jul. 29, 2022 (CN) ..... 202221999495.X

(51) Int. Cl.
*A46B 13/02* (2006.01)
*A46B 13/00* (2006.01)

(52) U.S. Cl.
CPC ..... *A46B 13/02* (2013.01); *A46B 13/008* (2013.01); *A46B 2200/30* (2013.01)

(58) Field of Classification Search
CPC ..... A46B 13/00; A46B 13/001; A46B 13/008; A46B 13/02; A46B 13/023; A46B 2200/30; A46B 2200/3046; A46B 2200/306; A46B 2200/3086
USPC ..... 15/28
See application file for complete search history.

(56) References Cited

U.S. PATENT DOCUMENTS 6,058,541 A * 5/2000 Masterman ..... A46B 9/06 15/207.2
2019/0174907 A1* 6/2019 Wang ..... A47K 7/04

FOREIGN PATENT DOCUMENTS

EP 3165126 A1 * 5/2017 ..... A46B 13/008
WO WO-2017105123 A1 * 6/2017 ..... A46B 11/08

* cited by examiner

*Primary Examiner* — Randall E Chin

(57) ABSTRACT

A powered tool brush includes: a connecting member, one end of which is a free end, at least part of the connecting member close to the free end is used for being connected to a rotation drive end of a powered tool; a structural support member, which is fixedly connected to another end of the connecting member; and an integrally formed brush head, the head having a bottom wall, a brush body and a side wall, the bottom wall is used for covering a surface position of the support member that is away from the connecting member, the body is formed by the bottom wall and/or the side wall extending in a direction away from the support member, and the side wall is formed by the bottom wall extending in a direction approaching the support member, and is used for wrapping and covering the periphery of the support member.

10 Claims, 6 Drawing Sheets

POWERED TOOL BRUSH AND POWERED TOOL HAVING SAME

CROSS REFERENCE TO RELATED APPLICATIONS

The present application claims the benefit of Chinese Patent Application No. 202221999495.X filed on Jul. 29, 2022, the contents of which are incorporated herein by reference in their entirety.

FIELD

The present application relates to the technical field of brushes, and in particular to a powered tool brush and a powered tool having same.

BACKGROUND

When dirt removal is performed in a manually brushing manner, dirt is often not completely brushed away due to insufficient friction between a brush head and a part to be subjected to dirt removal. Therefore, there is a powered tool brush in the market, for example, an electric drill brush head, which is generally made of plastic, and the plastic brush head is implanted in an electric drill bit, which has poor integrity. When in use, the plastic brush head is easily damaged and pressed to be crooked, and also causes a scratch on the surface of an article. Moreover, the plastic brush head located outermost is easily stuck in a slit of the part to be subjected to dirt removal, which results in bristle loss.

SUMMARY

The application aims to solve one of the technical problems in the related art at least to a certain extent. For this, the application provides a powered tool brush. A brush head is directly formed on a structural support member by integral injection moulding, and the brush head effectively wraps the structural support member, such that the two are prevented from sliding relative to each other or being disengaged from each other, thereby improving the integrity of the powered tool brush.

The application also provides a powered tool, which uses the powered tool brush.

The technical solution used in the application is: providing a powered tool brush, which includes:

- a connecting member, one end of which is a free end, where at least part of the connecting member that is close to the free end is used for being connected to a rotation drive end of a powered tool;
- a structural support member, which is fixedly connected to another end of the connecting member that is away from the free end; and
- an integrally formed brush head, the brush head having a bottom wall, a brush body and a side wall, where the bottom wall is used for covering a surface position of the structural support member that is away from the connecting member, the brush body is formed by the bottom wall and/or the side wall extending in a direction away from the structural support member, and the side wall is formed by the bottom wall extending in a direction approaching the structural support member, and is used for wrapping and covering the periphery of the structural support member.

After the above-mentioned structure is used, the bottom wall and the side wall of the brush head enclose to form a cavity for accommodating the structural support member, which cavity can effectively wrap the structural support member. The brush body is directly formed on the bottom wall by integral injection moulding, and the brush body includes a plurality of bristle structures formed by the bottom wall extending in the direction away from the support member. The bonding force between the bristle structures and the bottom wall is strong, such that the bristle structures are not easily damaged and pressed to be crooked and are not prone to disengagement, and the integrity of the powered tool brush is improved.

According to one embodiment of the application, the brush head is also provided with an edge covering part, and the edge covering part is an annular structure formed by the side wall extending towards the axis position of the brush head.

According to one embodiment of the application, a surface of the structural support member inwardly recesses to form an anti-skid groove, the brush head is provided with an anti-skid contour, which is fitted to the anti-skid groove. The provision of the anti-skid groove and the anti-skid contour can enhance the bonding force between the structural support member and the brush head, so as to prevent the two from rotating relative to each other by taking the central axis of the structural support member as a rotation axis, thereby effectively transferring a torque from a power unit to the position of the brush head.

According to one embodiment of the application, the brush head is formed by the structural support member by means of injection moulding or glue injection machining and in the form of an insert.

According to one embodiment of the application, the brush head is provided with an injection moulding support hole, and the injection moulding support hole is fitted to a support rod for supporting the structural support member in a mould.

According to one embodiment of the application, the connecting member is made of metal, and the structural support member is formed by the connecting member by means of injection moulding or glue injection machining and in the form of an insert.

According to one embodiment of the application, the bottom wall is provided with a bristle implantation part for the implantation of bristle into the structural support member, and the bristle implantation part is located within a region, which is covered by the brush head. The bristle implantation part is located within the region, which is covered by the brush head, and the outermost bristle brush head of the bristle implantation part does not easily come into contact with the slit of a part to be subjected to dirt removal, which contact results in bristle loss.

According to one embodiment of the application, the bottom wall extends in a direction away from the structural support member to form a circle of an anti-splashing part, and the brush head and/or the bristle implantation part is located within the circle of the anti-splashing part.

According to one embodiment of the application, the connecting member is a square handle, a cylindrical handle, a five-pit handle or a hexagonal handle.

According to one embodiment of the application, the brush head is made of TPR and/or TPE and/or TPU and/or silica gel.

A powered tool includes the powered tool brush according to any one of the above embodiments, and a powered tool body. the powered tool body is provided with the rotation drive end, which rotates around an axis, and the powered tool brush is connected to the rotation drive end by means of the connecting member. The powered tool includes a pneumatic powered tool, an electric powered tool and hydraulic powered tool, and a combination thereof.

Compared with the existing technique, the beneficial effects of the application are as follow.

1. In the application, a brush body and an edge covering part are provided, so as to not damage the surface of an article. Moreover, the brush body can be made of a material having a strong resilient force, such as TPR and/or TPE and/or TPU and/or silica gel, has the functions of great dirt removal capability, durability and hair adsorption, and would not be crushed owing to the resilient force of the brush body.

2. In the application, powered tool brushes of different shapes are provided, such that when in use, a brush head can be quickly replaced according to use requirements and by means of an electric tool matching the connecting member. The application can be used for washing a vehicle, washing a wheel hub, washing vehicle interior, washing a shower room, washing a carpet, washing the ground, etc., are applicable to the cleaning of surfaces of various articles, and has higher applicability.

DESCRIPTION OF REFERENCE SIGNS IN THE ACCOMPANYING DRAWINGS

1. connecting member; 2. structural support member;
3, 4, 5: brush head;
21. anti-skid groove;
31, 41, 51: bottom wall;
32, 42, 52: brush body;
33, 43: side wall;
34, 44: edge covering part;
35. anti-skid contour;
36, 55: injection moulding support hole;
53. bristle implantation part; and
54. anti-splashing part.

DETAILED DESCRIPTION OF THE EMBODIMENTS

The embodiments of the application will be described in detail below. The examples of the embodiments are shown in the accompanying drawings. Throughout the accompanying drawings, the same or similar reference signs represent the same or similar elements, or elements having the same or similar functions. The embodiments described below with reference to the accompanying drawings are exemplary, and are merely used for explaining the application and should not be construed as limiting the application.

Figure 2:
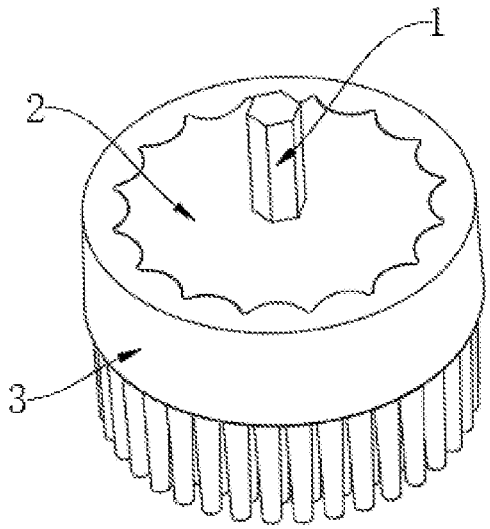
FIG. 2 is a structural schematic diagram of a powered tool brush in an embodiment of the application.

As shown in FIG. 2, the embodiment provides a powered tool brush, including: a connecting member 1, one end of which is a free end, where at least part of the connecting member 1 that is close to the free end is used for being connected to a rotation drive end of a powered tool; a structural support member 2, which is fixedly connected to another end of the connecting member 1 that is away from the free end; and an integrally formed brush head 3, the brush head 3 having a bottom wall 31, a brush body 32 and a side wall 33, where the bottom wall 31 is used for covering a surface position of the structural support member 2 that is away from the connecting member 1, the brush body 32 is formed by the bottom wall 31 and/or the side wall 33 extending in a direction away from the structural support member 2, and the side wall 33 is formed by the bottom wall 31 extending in a direction approaching the structural support member 2, and is used for wrapping and covering the periphery of the structural support member 2.

Figure 3:
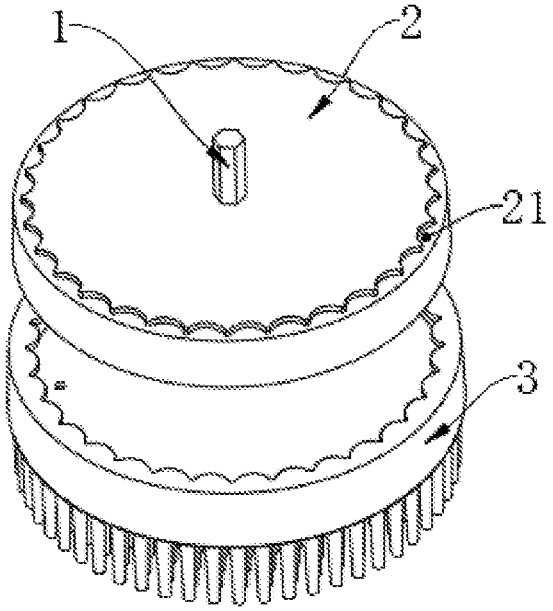
FIG. 3 is an exploded view of the powered tool brush in the embodiment of the application.
Figure 4:
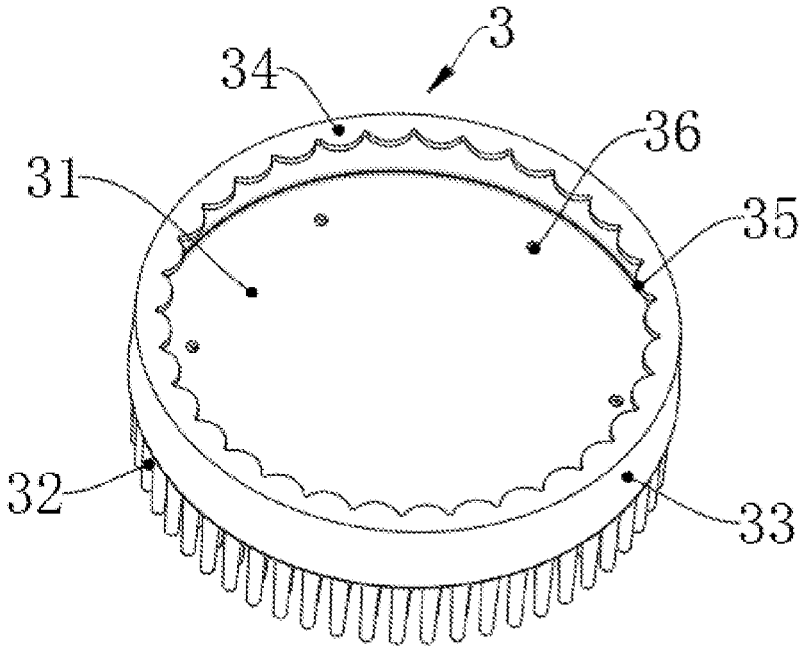
FIG. 4 is a structural schematic diagram of a brush head in an embodiment of the application.

Furthermore, as shown in FIG. 3 and FIG. 4, in another embodiment, the structural support member 2 is a cylindrical structure. The cylinder is formed by extending in an axial direction of the connecting member 1. In the embodiment, the radius of the structural support member 2 is greater than the height thereof, such that the shape of the structural support member 2 is similar to a round disk or a round cake.

Specifically, as shown in FIG. 4, the brush head 3 is also provided with an edge covering part 34, and the edge covering part 34 is an annular structure formed by the side wall 33 extending towards the axis position of the brush head 3.

Furthermore, in the embodiment, the bottom wall 31 on the brush head 3 is in a round shape fitted to the lower surface of the structural support member 2. The side wall 33 is formed by an edge of the bottom wall 31 extending upwards, and the bottom wall 31 and the side wall 33 enclose to form a cylindrical cavity for accommodating the structural support member 2. The edge covering part 34 is an inward-flanging structure formed by an inner edge of the upper side of the side wall 33 inwardly extending, and is used for being adhered to the upper surface of the structural support member 2.

Specifically, a surface of the structural support member 2 inwardly recesses to form an anti-skid groove 21, and the brush head 3 is provided with an anti-skid contour 35, which is fitted to the anti-skid groove 21.

Furthermore, in the embodiment, the anti-skid groove 21 is an annular groove structure formed by an edge of the upper surface of the structural support member 2 recessing downwards. The anti-skid groove 21 is of a structure of teeth, which are annularly arranged by taking the axis of the structural support member 2 as the center, and is used for increasing the bonding force between the annular groove and the edge covering part 34 on a circumferential surface.

Still furthermore, the provision of the anti-skid groove 21 and the anti-skid contour 35 can enhance the bonding force between the structural support member 2 and the brush head 3, so as to prevent the two from rotating relative to each other by taking the central axis of the structural support member 2 as a rotation axis, thereby effectively transferring a torque from a power unit to the position of the brush head 3.

Furthermore, in another embodiment, the anti-skid groove 21 is designed as a plurality of grooves, and the plurality of grooves are annularly arranged by taking the axis of the structural support member 2 as the center.

Specifically, the brush head 3 is formed by the structural support member 2 by means of injection moulding or glue injection machining and in the form of an insert.

Furthermore, in the embodiment, the connecting member 1 is a metal hexagonal handle, the structural support member 2 is made of PP. The hexagonal handle is placed into a mould in the form of an insert, and the structural support member 2 is then formed by means of injection moulding, so that the connecting member 1 and the structural support member 2 are connected as one.

Specifically, the brush head 3 is provided with an injection moulding support hole 36, and the injection moulding support hole 36 is fitted to a support rod for supporting the structural support member 2 in the mould.

Furthermore, in the embodiment, an entirety composed of the structural support member 2 and the connecting member 1 is placed into the mould in the form of an insert, and the brush head 3 is then manufactured by means of an injection moulding process. The support rod in the mould abuts against the lower surface of the structural support member 2, and is used for enabling melt plastic to flow, in a mould cavity, to the lower part of the structural support member 2, so as to form the brush head 3.

Still furthermore, the plurality of injection moulding support holes 36 are uniformly distributed on the bottom wall 31.

Specifically, the connecting member 1 is made of metal, and the structural support member 2 is formed by the connecting member 1 by means of injection moulding or glue injection machining and in the form of an insert.

Specifically, in another embodiment, the connecting member 1 is of the shape of a square handle, a cylindrical handle or a five-pit handle.

Specifically, the brush head 3 is made of TPR and/or TPE and/or TPU and/or silica gel.

Furthermore, in the embodiment, the bottom wall 31, the brush body 32 and the side wall 33 are made of TPR, and the edge covering part 34 is made of TRR.

Furthermore, in another embodiment, the brush body 32 is made of TPR, and the bottom wall 31, the side wall 33 and the edge covering part 34 are made of TRR.

Figure 5:
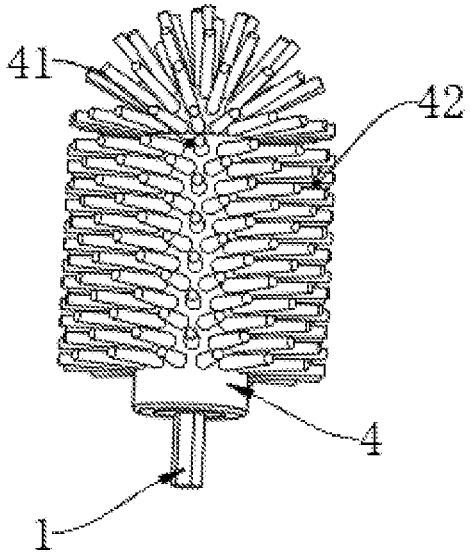
FIG. 5 is a structural schematic diagram of a powered tool brush in another embodiment of the application.
Figure 6:
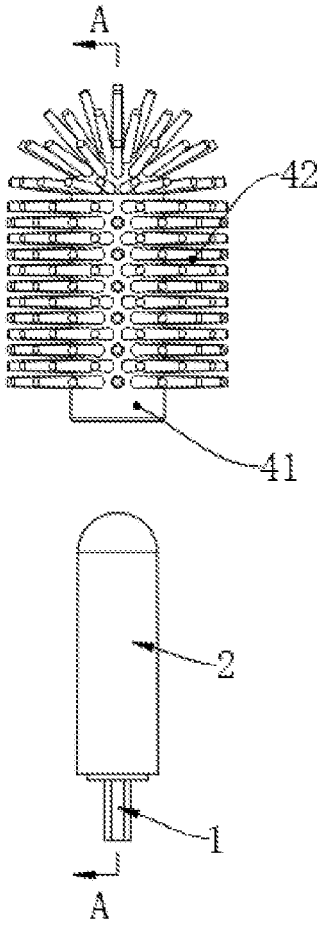
FIG. 6 is a partial exploded view of the powered tool brush in another embodiment of the application.
Figure 7:
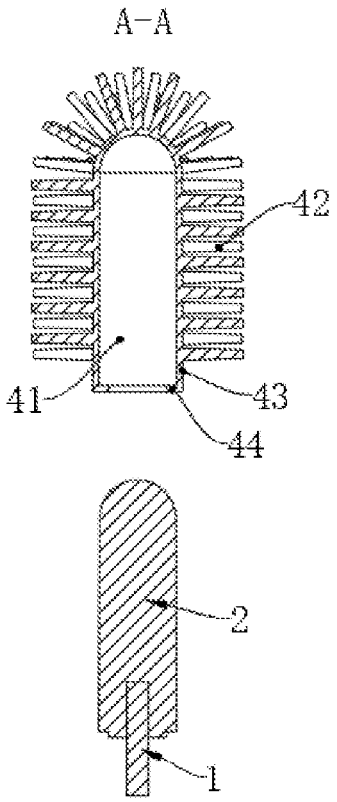
FIG. 7 is a cross-sectional view along line A-A in FIG. 6.

As shown in FIG. 5, FIG. 6 and FIG. 7, in the embodiment, the powered tool brush is a round disk brush, and in another embodiment, the powered tool brush is a bristle roller brush. That is, the structural support member 2 is a rod-shaped structure, the brush head 4 is also a rod-shaped structure, the bottom wall 41 and the side wall 43 enclose to form a rod-shaped cavity for accommodating the structural support member 2, the edge covering part 44 wraps and covers the anti-skid groove 21, and the brush body 42 is formed by the bottom wall 41 and the side wall 43 outwardly extending.

Figure 9:
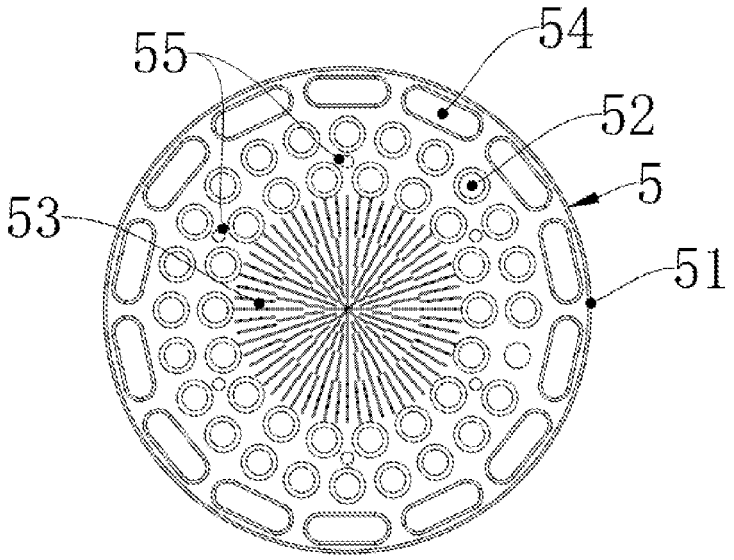
FIG. 9 is a top view of the powered tool brush in another embodiment of the application.

As shown in FIG. 9, a powered tool brush is disclosed in another embodiment, including: a connecting member 1, one end of which is a free end, where at least part of the connecting member 1 that is close to the free end is used for being connected to a rotation drive end of a powered tool; a structural support member 2, which is fixedly connected to another end of the connecting member 1 that is away from the free end; and an integrally formed brush head 5, the brush head 5 having a bottom wall 51, a brush body 52, a side wall and an anti-splashing part 54, where the bottom wall 51 is used for covering a surface position of the structural support member 2 that is away from the connecting member 1, both the brush body 52 and the anti-splashing part 54 are formed by the bottom wall 51 extending in a direction away from the structural support member 2, the anti-splashing part 54 is composed of a plurality of long-strip-shaped structures, the cross sections of which are flat, the plurality of long-strip-shaped structures are distributed on the outer ring of the brush body 52 and are formed in a surrounding manner in order to prevent liquid splashing, and the side wall 55 is formed by the bottom wall 51 extending in a direction approaching the structural support member 2, and is used for wrapping and covering the periphery of the structural support member 2. In addition, a bristle implantation part 53 is reserved at the central position of the bottom wall 51, hard PP bristle penetrates the bottom wall 51 to be implanted into the structural support member 2, and the bristle implantation part 53, the brush body 52 and the anti-splashing part 54 are in layout of concentric circles from inside to outside.

Figure 1:
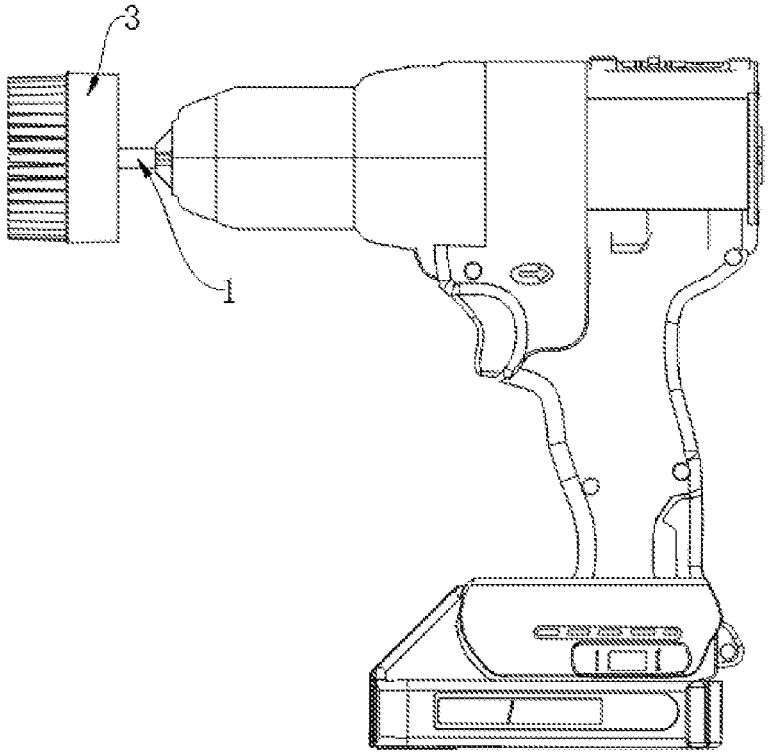
FIG. 1 is a structural schematic diagram of a powered tool in an embodiment of the application.
Figure 8:
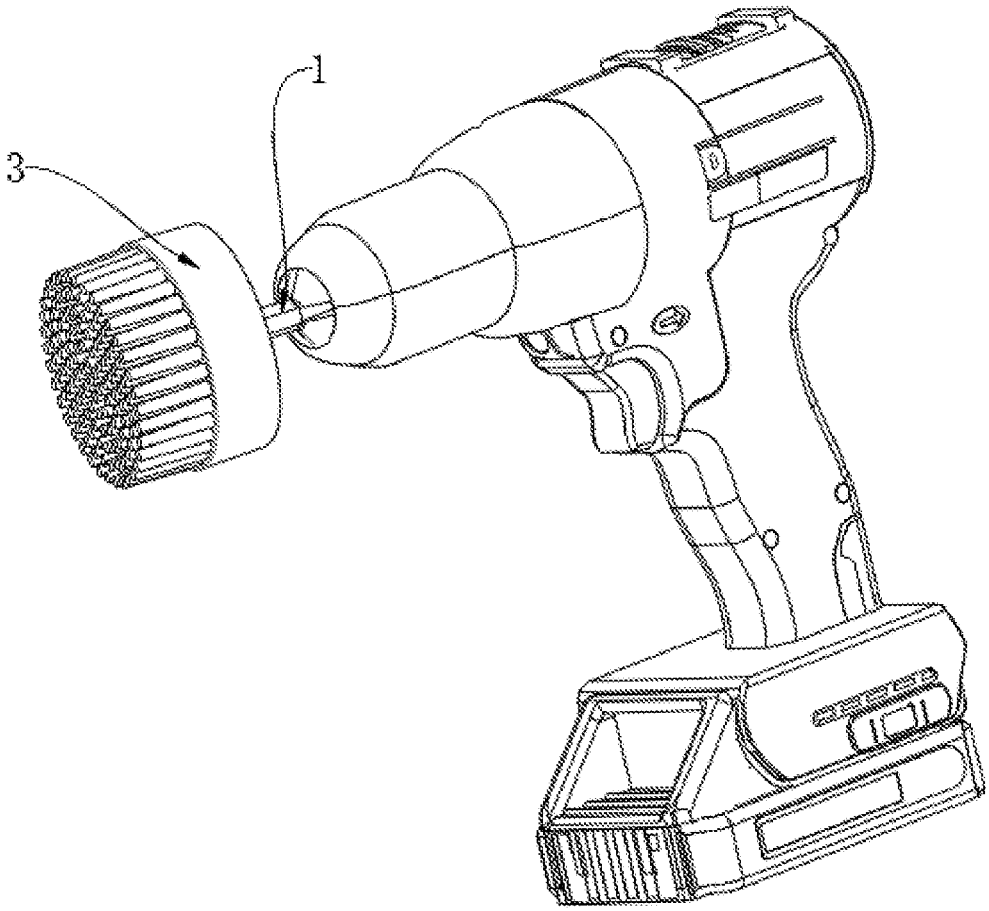
FIG. 8 is a perspective view of the powered tool in the embodiment of the application.

As shown in FIG. 1 and FIG. 8, a powered tool is disclosed in another embodiment, including the powered tool brush according to any one of the above embodiments, and a powered tool body. The powered tool body is provided with the rotation drive end, which rotates around an axis, and the powered tool brush is connected to the rotation drive end by means of the connecting member 1.

Furthermore, in another embodiment, the powered tool is a movable electric drill, and the rotation drive end thereof is connected to the powered tool brush by means of the connecting member 1.

The specific implementation process of the application is as follows. Brush heads 3 of different shapes are provided, such that when in use, different types of powered tool brush can be quickly replaced according to use requirements and by means of a powered tool matching the connecting member 1. The application can be used for washing a vehicle, washing a wheel hub, washing vehicle interior, washing a shower room, washing a carpet, washing the ground, etc., are applicable to the cleaning of surfaces of various articles, and has higher applicability. The brush body 32 and the side wall 33 are configured to be made of TPR, which does not damage the surface of an article, and the TPR brush body 32 has a hair adsorption function, and has stronger dirt removal capability. Moreover, the TPR brush body 32 has a strong resilient force, and thus would not be crushed.

In the description of the application, it should be understood that the orientation or positional relationships indicated by the terms "center", "longitudinal", "transverse", "length", "width", "thickness", "upper", "lower", "front"; "rear", "left", "right", "vertical", "horizontal", "top", "bottom", "inside", "outside", "clockwise", "counter-clockwise", "axial direction", "radial direction", "circumferential direction", etc. are based on the orientation or positional relationship shown in the accompanying drawings and are only for facilitating the description of the application and simplifying the description, rather than indicating or implying that the device or element referred to must have a particular orientation or be constructed and operated in a particular orientation, and therefore will not be interpreted as limiting the application.

In addition, the terms "first" and "second" are for descriptive purposes only and should not be construed as indicating or implying relative importance or implicitly indicating the number of technical features indicated. Thus, features defined with "first" and "second" may explicitly or implicitly include at least one of the features. In the description of the application, "a plurality of" means at least two, for example, two, three, etc., unless specifically defined otherwise.

In the application, unless specifically defined otherwise, a first feature being "above" or "under" a second feature may be that the first feature and the second feature are in direct contact, or that the first feature and the second feature are in indirect contact via an intermediate medium. Moreover, the first feature being "above", "over" and "on" the second feature may be that the first feature is directly above or diagonally above the second feature, or merely represents that the horizontal height of the first feature is higher than that of the second feature. The first feature being "under", "below" and "beneath" the second feature may be that the first feature is directly under or diagonally under the second feature, or merely represents that the horizontal height of the first feature is lower than that of the second feature.

Although the embodiments of the application have been shown and described above, it should be understood that the above-mentioned embodiments are merely exemplary and should not be construed as limiting the application. Those skilled in the art may make changes, modifications, replacements and variations to the above-mentioned embodiments within the scope of the application.

The invention claimed is:

1. A powered tool brush, comprising:

a connecting member (1), one end of which is a free end, wherein at least part of the connecting member (1) that is close to the free end is used for being connected to a rotation drive end of a powered tool;

a structural support member (2), which is fixedly connected to another end of the connecting member (1) that is away from the free end; and an integrally formed brush head (3, 4, 5), the brush head (3, 4, 5) having a bottom wall (31, 41, 51), a brush body (32, 42, 52) and a side wall (33, 43), wherein the bottom wall (31, 41, 51) is used for covering a surface position of the structural support member (2) that is away from the connecting member (1), the brush body (32, 42, 52) is formed by the bottom wall (31, 41, 51) and/or the side wall (33, 43) extending in a direction away from the structural support member (2), and the side wall (33, 43) is formed by the bottom wall (31, 41, 51) extending in a direction approaching the structural support member (2), and is used for wrapping and covering a periphery of the structural support member (2).

2. The powered tool brush according to claim 1, wherein the brush head (3, 4, 5) is also provided with an edge covering part (34, 44), and the edge covering part (34, 44) is an annular structure formed by the side wall (33, 43) extending towards an axis position of the brush head (3, 4, 5).

3. The powered tool brush according to claim 2, wherein a surface of the structural support member (2) inwardly recesses to form an anti-skid groove (21), and the brush head (3, 4, 5) is provided with an anti-skid contour (35), which is fitted to the anti-skid groove (21).

4. The powered tool brush according to claim 1, wherein the brush head (3, 4, 5) is formed by the structural support member (2) by means of injection moulding or glue injection machining and in the form of an insert.

5. The powered tool brush according to claim 4, wherein the brush head (3, 4, 5) is provided with an injection moulding support hole (36, 55), and the injection moulding support hole (36) is fitted to a support rod for supporting the structural support member (2) in a mould.

6. The powered tool brush according to claim 1, wherein the connecting member (1) is made of metal, and the structural support member (2) is formed by the connecting member (1) by means of injection moulding or glue injection machining and in the form of an insert.

7. The powered tool brush according to claim 6, wherein the bottom wall (51) is provided with a bristle implantation part (53) for the implantation of bristle into the structural support member (2), and the bristle implantation part (53) is located within a region, which is covered by the brush head (5).

8. The powered tool brush according to claim 7, wherein the bottom wall (51) extends in a direction away from the structural support member (2) to form a circle of an anti-splashing part (54), and the brush body (52) and/or the bristle implantation part (53) is located within the circle of the anti-splashing part (54).

9. The powered tool brush according to claim 1, wherein the connecting member is a square handle, a cylindrical handle, a five-pit handle or a hexagonal handle.

10. A powered tool, comprising the powered tool brush according to claim 1, and a powered tool body, wherein the powered tool body is provided with the rotation drive end, which rotates around an axis, and the powered tool brush is connected to the rotation drive end by means of the connecting member (1).

* * * * *